US006176093B1

(12) United States Patent
Stein et al.

(10) Patent No.: US 6,176,093 B1
(45) Date of Patent: Jan. 23, 2001

(54) AUTOMOTIVE AIR CONDITIONING REFRIGERANT FILTER AND METHOD

(75) Inventors: Myron Stein, Laguna Niguel, CA (US); Tommy P. Potate, Woodstock, GA (US)

(73) Assignee: AirSept, Inc., Marietta, GA (US)

( * ) Notice: Under 35 U.S.C. 154(b), the term of this patent shall be extended for 0 days.

(21) Appl. No.: 09/396,039

(22) Filed: Sep. 15, 1999

(51) Int. Cl.[7] ..... F25B 47/00; F25B 43/00
(52) U.S. Cl. ..... 62/85; 62/474; 55/428
(58) Field of Search ..... 62/85, 299, 474, 62/475; 210/287; 55/428, 429, 432, 480

(56) References Cited

U.S. PATENT DOCUMENTS

| | | | |
|---|---|---|---|
| 979,481 | 12/1910 | Hannold . | |
| 2,202,403 | 5/1940 | Sandberg | 210/164 |
| 2,645,099 | 7/1953 | Cumming | 62/115 |
| 2,702,993 | 3/1955 | Harris | 62/115 |
| 4,376,331 | 3/1983 | Clark | 29/219 |
| 5,492,143 | 2/1996 | Cooper et al. | 137/15 |
| 5,586,378 | 12/1996 | Smith | 29/257 |
| 5,630,939 | 5/1997 | Bulard et al. | 210/416.1 |

FOREIGN PATENT DOCUMENTS

| | | | |
|---|---|---|---|
| 0594431 | * | 4/1994 | (EP) . |
| 403025265 | * | 2/1991 | (JP) . |

* cited by examiner

*Primary Examiner*—William Doerrler
*Assistant Examiner*—Chen-Wen Jiang
(74) *Attorney, Agent, or Firm*—Womble Carlyle Sandridge & Rice

(57) ABSTRACT

A method of preventing debris entrained in the refrigerant of an automotive air conditioning system from circulating through the compressor of the system is provided. The method comprises the steps of removing the compressor manifold from the compressor, pressing a mesh screen filter into at least one of the ports of the manifold with a manual press, and reinstalling the manifold on the compressor. The mesh screen filter traps debris entrained within the refrigerant and prevents the debris from entering the compressor. The invention also comprises a filter and press assembly for practicing the method of the invention.

21 Claims, 2 Drawing Sheets

AUTOMOTIVE AIR CONDITIONING REFRIGERANT FILTER AND METHOD

TECHNICAL FIELD

This invention relates generally to automotive air conditioning systems and more particularly to refrigerant filters for automotive air conditioning systems.

BACKGROUND

A typical automotive air conditioning system comprises a compressor in the engine compartment for compressing refrigerant and delivering the compressed refrigerant to a condenser. The compressed refrigerant is expanded in the condenser, causing to the condenser to be chilled. Air is blown through the chilled condenser, which cools the air, and into the passenger compartment to cool the vehicle. The expanded refrigerant is then returned to the compressor where it is again compressed and the cycle repeats.

The refrigerant loop usually is coupled to the compressor through a compressor manifold having an inlet port communicating with the low pressure side or "low side" of the compressor and an outlet port communicating with the high pressure side or "high side" of the compressor. High pressure compressed refrigerant is delivered to the condenser through a hose coupled to the high pressure port and expanded refrigerant is delivered back to the compressor for recompression through a hose coupled to the low pressure port. In general, the pressure of the refrigerant on the high side can be many times the pressure of the refrigerant on the low side. It is therefore common when the engine of a vehicle is shut off that the pressure differential between the high side and low side of the compressor self equalizes. When this occurs, compressed refrigerant in the hose connected to the high side of the compressor rushes back through the reed valves and cylinder of the compressor and into hoses coupled to the low side until the pressure is equalized. The rush of refrigerant in such an equalization sometimes is heard as an audible hiss after the engine is shut off.

Compressor failure can occur for a number of reasons. One common circumstance in which failure can occur is when debris such as a small sliver of metal from a reed valve, a shard of plastic or metal from a compressor piston ring, or dirt becomes entrained in the refrigerant and circulates through the compressor. Such debris can cause gradual deterioration of compressor components or, in some cases, can result in sudden catastrophic failure. When this occurs, the compressor must be replaced. One problem often associated with replacement of a defective compressor results from the aforementioned equalizing reflux of refrigerant back into the hose coupled to the low side of the compressor during operation of the old compressor. Specifically, debris entrained in the refrigerant becomes lodged in the low side hose and is not always removed by a refrigerant flush. Accordingly, when the new compressor is installed and operated, this debris again becomes entrained within the refrigerant and destroys the new compressor in the same way as the old. In some cases, a number of compressors have been installed on a vehicle only to be destroyed in turn by debris trapped in the system and entrained in the refrigerant. A need therefore exists for a method and apparatus of preventing debris entrained in the refrigerant of an automotive air conditioning system from circulating through a newly installed compressor. It is to the provision of such a method and apparatus that the present invention is primarily directed.

SUMMARY OF THE INVENTION

Briefly described, the present invention, in one preferred embodiment thereof, comprises a method and apparatus of preventing debris entrained within the refrigerant of an automotive air conditioning system from circulating through and ruining the compressor. The apparatus comprises a small thimble shaped filter having an outer rim sized to be pressed into the inlet and/or outlet port of a compressor manifold. The device also includes a manual press adapted to press and secure the filter in place within the manifold ports. In use, when a spent air conditioning compressor is replaced with a new compressor, or as a part of standard maintenance procedures, an auto mechanic uses the press to secure a filter of this invention in place in the low pressure port and, if desired, also in the high pressure of the compressor manifold. When the manifold is reattached to the new compressor and the system charged with refrigerant, debris that may be lodged within the hoses of the system, either on the high side or low side of the compressor is trapped by the filters and prevented from recirculating through the compressor. The filter on the low side prevents debris in the low side hose from being pumped through the compressor during normal operation and the filter on the high side prevents debris from flushing back through the compressor during refrigerant equalization. As a result, the new compressor is isolated from trapped debris in the system and thus receives only filtered refrigerant. Instances of subsequent failure are therefore reduced significantly.

Thus, a method and apparatus is now provided for efficiently and economically addressing the problem of continued automotive air conditioning compressor failure as a result of debris entrained within the refrigerant. The filter is easily installed by an auto mechanic as a standard step when replacing or servicing the compressor. Once installed, the filter isolates the compressor from debris to provide only filtered refrigerant to the compressor. Subsequent compressor failure is therefore reduced and compressor life is extended. These and other features, objects, and advantages of the invention will become more apparent upon review of the detailed description set forth below taken in conjunction with the accompanying drawings, which are briefly described as follows.

DETAILED DESCRIPTION

Figure 1:
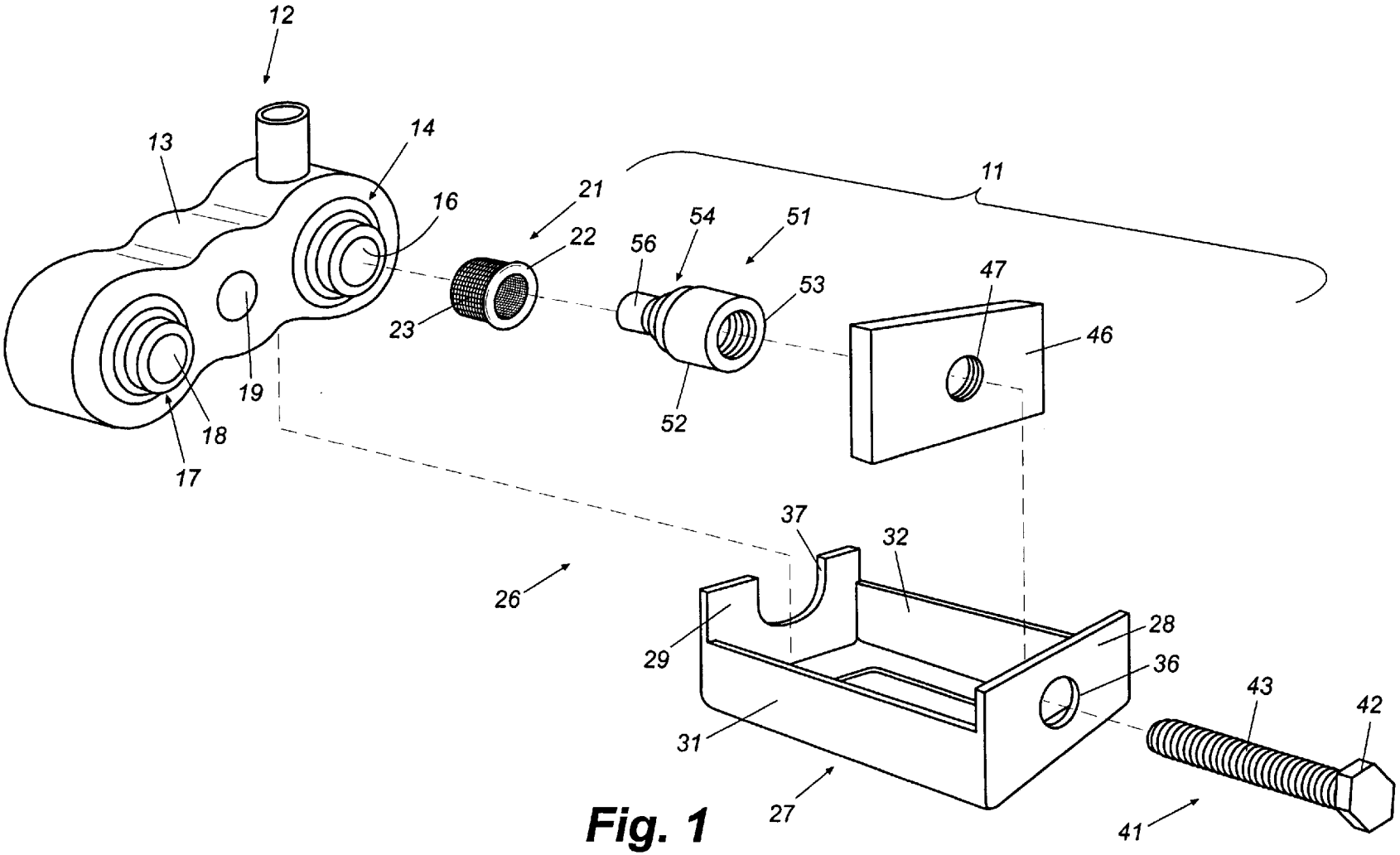
FIG. 1 is an exploded perspective view of a filter and press assembly that embodies principles of the present invention in a preferred form.

Referring now in more detail to the drawings, in which like numerals refer to like parts throughout the several views, FIG. 1 illustrates the present invention in perspective exploded format. A common air conditioning compressor manifold 12 is illustrated for purposes of describing the method and apparatus of the invention. The manifold 12 has a metal body 13, which usually is fabricated from aluminum. The body 13 is provided with a low side port 14 have a cylindrical inner wall 16 and a high side port 17 having a cylindrical inner wall 18. A mounting hole 19 is formed through the body 13 for a receiving a bolt that secures the manifold 12 to the back of an air conditioning compressor with the low side port 14 communicating with the inlet port of the compressor and with the high side port 17 communicating with the outlet port of the compressor. In use, compressed refrigerant is delivered through the high side port 17 to the condenser and expanded refrigerant is delivered back to the compressor through the low side port 14.

The present invention comprises a generally thimble shaped filter 21 having an annular rim 22 to which a mesh screen 23 is attached. In FIG. 1, the filter 21 is seen aligned for insertion into the low side port 14 of the manifold 12. It will be understood, however, that the filter 21 can be pressed in either the low side or high side port or, preferably, in both the low and high side ports. The invention further comprises a press assembly 11 for pressing the filter 21 into a port of the compressor manifold. The press assembly 11 includes a cradle 27 having a front wall 28, a back wall 29, and side walls 31 and 32. The front wall 28 is formed with an oversized through bore 36 through which a press bolt 41 having a threaded shaft 43 and a head 42 extends. An alignment plate 46 is provided with a threaded central bore 47. The alignment plate 46 is sized to be received within the cradle 27 and to rest against the inside surface of the front wall 28. The threaded shaft 43 extends through the oversized through bore 36 and is threadable received through the threaded central bore 47 of the alignment plate 46. Since the through bore 36 in the front wall 28 of the cradle 27 is oversized relative to the threaded shaft 43, it can be seen that the lateral position of the press bolt 41 is adjustable within the cradle 27.

A mandrill 51 is formed with a threaded bore 53 and is sized to be threaded onto the end of the threaded shaft 43 of the press bolt 41. The mandrill 51 has a generally cylindrical body 52, a cylindrical distal end 56, and stepped gauges 54 intermediate its ends. The distal end 56 is sized to fit within the thimble shaped filter 21 and the stepped gauges 54 are sized to gauge the depth to which the filter 21 is pressed into a port of the manifold and to ensure that the filter is pressed squarely into the port, as described in more detail below.

Figure 2:
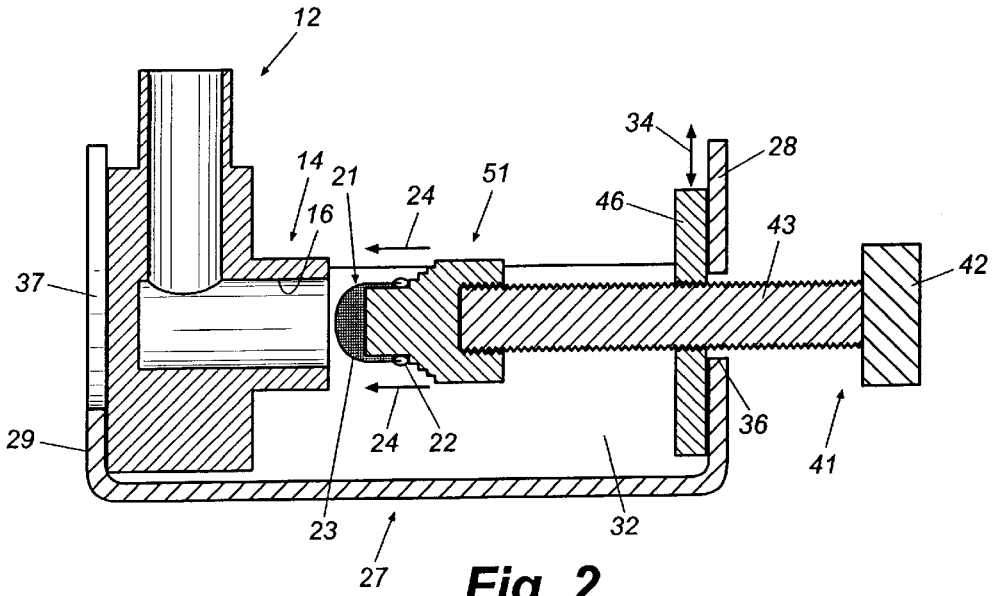
FIG. 2 is a longitudinal section illustrating installation of a filter of this invention in a port of a compressor manifold.

FIG. 2 illustrates the invention as it appears assembled and being used to press a filter into a port of an air conditioning compressor manifold. The compressor manifold 12 is seen resting against the back wall 29 of the cradle 27 with its low side port 14 facing the front wall 28. The press bolt 41 extends through the oversized bore 36 in the front wall 28 and is threaded through the alignment plate 46. The mandrill 51 is threadably secured on the end of the press bolt 41 and the filter 21 is mounted on the end of the mandrill.

To press the filter 21 into the port 14, the press bolt 41 is rotated to advance the mandrill and filter toward the port 14 as indicated by arrows 24. As the filter 21 moves into the port 14, the press bolt 41 self adjusts laterally by virtue of the alignment plate 46. This is possible because the bore 36 in the front wall 28 is oversized relative to the press bolt and the press bolt is free to move laterally within the bore with the alignment plate moving relative to the front wall 28. Accordingly, the press of this invention is self-aligning.

Figure 4:
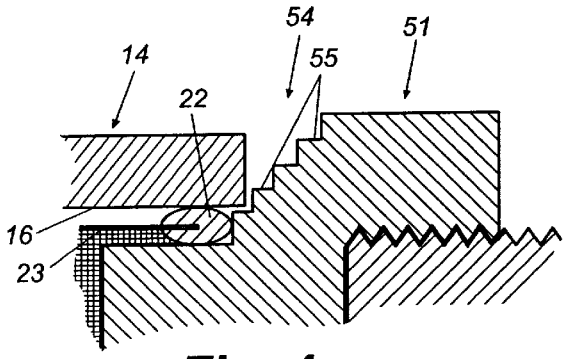
FIG. 4 is an enlarged sectional view illustrating the function of the stepped gauge of the mandrel of the press to gauge the depth to which the filter is pressed into the port.

When the filter has advanced sufficiently so that its annular rim 22 engages the mouth of the port 14, further advancement of the press bolt 41 presses the annular rim tightly within the cylindrical inner wall 16 of the port 14. This is best illustrated in FIG. 4. The individual steps 55 of the stepped gauge 54 are carefully sized to gauge the depth to which the annular rim 22 of the filter 21 is pressed into the port 14. More specifically, in FIG. 4, the inner step of the stepped gauge fits within the cylindrical inner wall 16 of the port 14 while the next successive step of the gauge engages the outer rim of the port. Thus, when the mandrill is fully advanced into the port 14, the filter 21 is pressed into the port a predetermined distance and is also centered and aligned within the port for proper operation and to avoid the filter becoming dislodged. Other steps of the stepped gauge are sized to accommodate ports of other diameters.

Once the filter has been pressed completely into the port 14, the press bolt 41 is rotated to retract the mandrill 51 from the port 14, leaving the filter firmly in place within the port. The compressor manifold 12, which previously has been removed from the compressor, can then be reinstalled on the compressor or on a newly replaced compressor. Once the air conditioning system is recharged, the compressor is operated in the normal way except that the filter 21 prevents debris that may become entrained within the refrigerant from entering and ruining the compressor.

Figure 3:
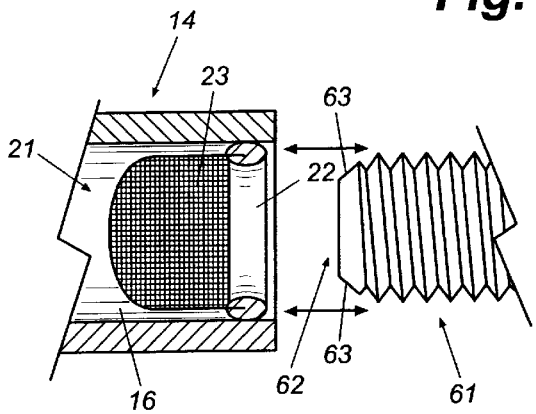
FIG. 3 is an enlarged sectional view illustrating removal of the filter when it is desired to replace the filter with a fresh filter.

After a predetermined period of operation or upon subsequent re-replacement of the compressor, it may become necessary to remove the filter 21 from the manifold 12 for replacement. FIG. 3 illustrates a preferred method and device of removing the filter. A threaded removal tool 61 has a plurality of threads and a tapered end portion 62. The end portion 62 is tapped around its periphery, as indicated by reference numeral 63. To remove the filter 21 from the port 14, the removal tool 61 is threaded into the annular rim 22 of the filter. As the removal tool 61 advances, the threads of the tool eventually engage the inner surface of the annular rim 22. When the threads are firmly lodged within the annular rim 22, the removal tool is retracted from the port 14, which dislodges the filter 21 and removes it from the port. The filter can then be replaced with a new filter in the manner previously described.

Accordingly, it can be seen that the present invention, in one embodiment, comprises a method of preventing debris entrained in the refrigerant of an automotive air conditioning system from circulating through and destroying the compressor of the system. The method comprises the steps of removing the compressor manifold from the compressor, installing a filter in at least one of the ports of the manifold, and reinstalling the manifold on the compressor. Preferably, the filter is installed by being pressed into a port of the manifold where it is held with a firm friction fit. However, other methods of installing the filter may also be used and all are considered to be within the scope of the present invention. Also, while it is prudent to install a filter of this invention at least in the low side port of the compressor manifold, installation of a filter in the low and high side ports or in only the high side port is also possible and contemplated to be within the scope of the invention.

The invention has been described in terms of preferred embodiments and methodologies. It will be obvious to those of skill in the art, however, that various additions, deletions, and modifications might well be made to the illustrated embodiments without departing from the spirit and scope of the invention as set forth in the claims. For example, the filter can be installed in the manifold using a rubber or soft face mallet. The disclosed press is convenient however, because of the tight space usually found when working on an automotive air conditioning compressor. Further, the method and apparatus of this invention is equally applicable to other types of hydraulic lines in addition to air conditioning refrigerant lines. These and other modifications are possible within the scope of the claims.

What is claimed is:

1. In an automotive air conditioning system having a compressor to which a manifold having a low side port coupled to the low pressure hose of the system and a high side port coupled to the high pressure hose of the system is attached, a method of preventing debris entrained in the refrigerant of the system from circulating through and destroying the compressor comprising the steps of:

(a) removing the manifold from the compressor;

(b) installing a filter in at least one of the ports of the manifold; and (c) reinstalling the manifold on the compressor.

2. The method of claim 1 and wherein step (b) comprises pressing the filter into the port to secure the filter with a friction fit.

3. The method of claim 2 and wherein the step of pressing the filter into the port comprises placing the manifold in a press having a mandrel positioned to be advanced into the port, placing the filter on the mandrel, and advancing the mandrel into the port to press the filter into the port.

4. The method of claim 1 and wherein step (b) comprises installing the filter in the low side port.

5. The method of claim 1 and wherein step (b) comprises installing the filter in the high side port.

6. The method of claim 1 and wherein step (b) comprises installing a filter in the low side port and the high side port.

7. The method of claim 1 and wherein the filter is generally thimble-shaped having a rim sized to be secured within a port with a friction fit and wherein step (b) comprises pressing the rim of the filter into the port to secure the filter in place.

8. The method of claim 1 and wherein the filter comprises a mesh screen filter.

9. A method of filtering the refrigerant in an automotive air conditioning system having a compressor and a manifold with low and high side ports mounted to the compressor to prevent debris entrained in the refrigerant from circulating through the compressor, the method comprising the steps of removing the manifold from the compressor, pressing a filter in at least one of the ports of the manifold, and reinstalling the manifold on the compressor.

10. The method of claim 9 and wherein the step of pressing a filter in at least one of the ports comprises pressing the filter in the low side port.

11. The method of claim 9 and wherein the step of pressing a filter in at least one of the ports comprises pressing the filter in the high side port.

12. The method of claim 9 and wherein the step of pressing a filter in at least one of the ports comprises pressing a filter in the low side port and pressing a filter in the high side port.

13. The method of claim 9 and wherein the step of pressing a filter in at least one of the ports comprises placing the manifold in a press having a mandrel positioned to be advanced into the at least one port, mounting the filter on the mandrel, and advancing the mandrel into the at least one port to press the filter into the port.

14. The method of claim 13 and wherein the filter is generally thimble-shaped having an annular rim sized to fit with a friction fit into the at least one port and wherein the rim is pressed into the port as the mandrel is advanced to secure the filter in place.

15. A refrigerant filter for installation in a selected port of the compressor manifold of an automotive air conditioning system, said refrigerant filter comprising an annular rim sized to be pressed into the port and held in placed with a friction fit and a mesh screen spanning said annular rim for trapping debris entrained in the refrigerant of the air conditioning system to prevent the debris from circulating through the compressor.

16. A refrigerant filter as claimed in claim 15 and wherein said mesh screen is generally thimble-shaped.

17. An apparatus for installing a filter in at least one port of the compressor manifold of an automotive air conditioning system to prevent debris entrained in the refrigerant of the system from circulating through the compressor, said apparatus comprising a filter adapted to be press fit in the port and a press assembly for pressing said filter into the port.

18. An apparatus for installing a filter in at least one port of the compressor manifold of an automotive air conditioning system as claimed in claim 17 and wherein said filter is generally thimble-shaped having an annular rim to which a mesh screen is attached.

19. An apparatus for installing a filter in at least one port of the compressor manifold of an automotive air conditioning system as claimed in claim 18 and wherein said press assembly includes a cradle for receiving the compressor manifold and a press bolt positioned to be advanced toward the port for pressing said filter into said port.

20. An apparatus for installing a filter in at least one port of the compressor manifold of an automotive air conditioning system as claimed in claim 19 and further comprising a mandrill mounted on said press bolt, said mandrill having a stepped gauge for gauging the depth to which said filter is pressed into the port.

21. An apparatus for installing a filter in at least one port of the compressor manifold of an automotive air conditioning system as claimed in claim 20 and wherein said press bolt is laterally adjustable relative to said cradle for precise alignment of said mandrill and a filter mounted thereto with the port of the compressor manifold.

* * * * *